US005292448A

United States Patent [19]

Klugkist

[11] Patent Number: 5,292,448

[45] Date of Patent: Mar. 8, 1994

[54] ENZYMATIC DETERGENT COMPOSITION

[75] Inventor: Jan Klugkist, Vlaardingen, Netherlands

[73] Assignee: Lever Brothers Company, Division of Conopco, Inc., New York, N.Y.

[21] Appl. No.: 11,086

[22] Filed: Jan. 29, 1993

Related U.S. Application Data

[63] Continuation of Ser. No. 350,054, May 10, 1989, abandoned.

[30] Foreign Application Priority Data

May 10, 1988 [GB] United Kingdom ..... 881045

[51] Int. Cl.[5] ..... C11D 3/386; C11D 1/83; C11D 17/06

[52] U.S. Cl. ..... 252/174.12; 252/174.14; 252/174.19; 252/174.21; 252/174.25; 252/546; 252/DIG. 12; 252/DIG. 14

[58] Field of Search ..... 252/174.12, DIG. 12; 435/264

[56] References Cited

U.S. PATENT DOCUMENTS

| | | | |
|---|---|---|---|
| 3,676,338 | 7/1972 | Fries et al. | 252/8.75 |
| 3,676,340 | 7/1972 | Berg et al. | 252/8.75 |
| 3,676,374 | 7/1972 | Zaki et al. | 252/551 |
| 3,950,277 | 4/1976 | Stewart et al. | 252/541 |
| 4,011,169 | 3/1977 | Diehl et al. | 252/95 |
| 4,707,291 | 11/1987 | Thom et al. | 252/174.12 |

FOREIGN PATENT DOCUMENTS

| | | |
|---|---|---|
| 0003172 | 7/1979 | European Pat. Off. . |
| 25551B1 | 3/1981 | European Pat. Off. . |
| 0130064 | 1/1985 | European Pat. Off. . |
| 0204284 | 12/1986 | European Pat. Off. . |
| 0205208 | 12/1986 | European Pat. Off. . |
| 0206390 | 12/1986 | European Pat. Off. . |
| 0214761 | 3/1987 | European Pat. Off. . |
| 0238023 | 9/1987 | European Pat. Off. . |
| 0243338 | 10/1987 | European Pat. Off. . |
| 0258068 | 3/1988 | European Pat. Off. . |
| 0266199 | 5/1988 | European Pat. Off. . |
| 0268452 | 5/1988 | European Pat. Off. . |
| 0268456 | 5/1988 | European Pat. Off. . |
| 0271152 | 6/1988 | European Pat. Off. . |
| 0305216 | 3/1989 | European Pat. Off. . |
| 1942236 | 3/1971 | Fed. Rep. of Germany . |
| 63-077998 | 4/1988 | Japan . |
| 63-078000 | 4/1988 | Japan . |
| 63-132998 | 6/1988 | Japan . |
| 1372034 | 10/1974 | United Kingdom . |

OTHER PUBLICATIONS

Biotechnology Newswatch, Mar. 7, 1988, p. 6.

Tensider 1979, 16 82,89 (in German).

*Primary Examiner*—Paul Lieberman

*Assistant Examiner*—A. Hertzog

*Attorney, Agent, or Firm*—Ronald A. Koatz

[57] ABSTRACT

A detergent composition comprising an anionic surfactant, a nonionic surfactant and a lipase enzyme, characterised in that:

(a) the nonionic surfactant of the composition comprises a nonionic surfactant component selected from alkoxylate adducts of fatty alcohols, fatty acids, fatty esters, fatty amides and fatty amines of at least $C_{10}$ chain length and mean alkylene oxide content of less than 5 alkylene oxide groups per molecule, forming at least 30% by weight of the total nonionic surfactant of the composition; and in that (b) the total amount of the nonionic and anionic surfactant in the composition is in the range 1% to 30% by weight; and (c) the lipase enzyme is present in an amount of about 0.005 to 100 Lu/mg based on the weight of the detergent composition.

7 Claims, No Drawings

ENZYMATIC DETERGENT COMPOSITION

This is a continuation or application of Ser. No. 7/350,054, filed May 10, 1989, now abandoned.

The present invention relates to an enzymatic detergent composition. More particularly it relates to an enzymatic detergent composition which contains a lipolytic enzyme.

PRIOR ART & DISCLOSURE STATEMENT

In the following section, there are discussed not only certain publications published before the priority date claimed for this invention, but also certain matters not so published.

Enzymatic detergent compositions are well known in the art. Enzymes of many types have been proposed for inclusion in detergent compositions, but the main attention has been focussed on proteases and amylases. Lipases have been mentioned as possible enzymes for detergent compositions. Thus, our British Patent Specification 1 372 034 discloses the use of lipases produced by microorganisms of the Pseudomonas group, such as *Pseudomonas stutzeri* ATCC 19 154, in detergent compositions for soaking fabrics which contain specific nonionic detergent actives, mentioning nonylphenols condensed with 5 or 10 moles of ethylene oxide, and secondary alcohols condensed with 3, 7 or 9 moles of ethylene oxide, optionally with a specific anionic detergent active. However, it was made clear that "the mere addition of lipoeytic enzymes to any and all detergent compositions does not produce, (as was shown) a satisfactory and acceptable detergent composition both regarding the enzyme activity and the cleaning efficiency. Various ingredients of detergent compositions have been found to exert a negative influence on lipolytic enzymes".

U.S. Pat. No. 3,950,277 (Procter & Gamble) also describes fabric-soaking compositions: the described compositions comprise lipase and lipase activators and a number of lipases from microorganism and other sources are mentioned: those particularly mentioned as preferred are Amano CE, Amano M-AP, Takeda 1969-4-9, and Meito MY-30 lipases, but no indications are given of the form in which the lipase is to be prepared or used.

U.S. Pat. No. 4,011,169/NL 74 08763 (Procter & Gamble) describes the use of a similar range of enzymes in the preparation of additives for washing agents (detergent compositions).

Examples of known lipase-containing detergent compositions are provided by EP 0 205 208 and 0 206 390 (Unilever), which relate to lipases related to those from Ps. fluorescens, P gladioli and Chromobacter in detergent compositions.

EP 0 214 761 (Novo) and EP 0 258 068 (Novo), each give detailed description of lipases from certain microorganisms, and also give certain uses in detergent additives and detergent compositions for the enzymes described. EP 0 214 761 gives detailed description of lipases derived from organisms of the species Pseudomonas cepacia, and certain uses therefor. EP 0 258 068 gives detailed description of lipases derived from organisms of the genus Thermomyces/Humicola, and certain uses therefor.

Also believed to be in use in certain areas is a lipase-containing granular detergent composition containing about 37% detergent actives including 5% nonionic detergent and the remainder substantially anionic detergent, about 16% zeolite, about 60 LU/g lipase, plus protease and other normal detergent additives.

Further examples of known lipase-containing detergent compositions are provided by J)A 63-078000 (1988) (Lion Corp/K Mukoyama et al) which discloses properties and uses of a Pseudomonas lipase, including use in a lipase-containing system based on 10–40 % surfactant (e.g., sodium C14–C18 alpha-olefin sulphonate), as well as other conventional detergent ingredients.

In EP 0 268 456 (Clorox), there is described in connexion with Table 10(b) an experimental washing solution containing lipase and about 1 microgram/ml sodium dodecyl sulphate.

In U.S. Pat. No. 4,707,291 detergent compositions have been described which contain a special class of lipases. These compositions contain a mixture of an anionic and a nonionic detergent as the active detergent system.

Nonionic alkoxylated detergents are of frequent occurrence and use, and sometimes their use has been mentioned in connection with lipase.

Thus, further specifications relevant in this connexion are EP 0258 068 (Novo), EP 0 130 064 (Novo), EP 0 206 390 (Unilever), U.S. Pat. No. 3,676,340 (Berg et al—Henkel), U.S. Pat. No. 3,676,338 (Fries et al—Henkel), DE 1 942 236 (Henkel), and the following Japan specifications: 63-132998 (Lion), 63-078000 (Lion), and 63-077998 (Hitachi).

THE PRESENT INVENTION

We have now discovered that the inclusion of a certain class of nonionic detergents, i.e. alkoxylated nonionics of low alkoxylation degree, as more particularly defined below in certain types of lipase-containing detergent composition (e.g. according to the above U.S. Pat. No. 4,707,291) can provide an improved overall detergency.

The lipases used in the present invention include for example those lipases which show a positive immunological cross-reaction with the antibody of the lipase, produced by the microorganism *Pseudomonas fluorescens* IAM 1057, as described in U.S. Pat. No. 4,707,291, hereby incorporated herein by reference.

Examples of suitable lipases for use in this invention are Amano-P lipase, lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from US Biochemical Corp., U.S.A. and Diosynth Co., the Netherlands, and lipases ex *Pseudomonas gladioli.*

Preferred lipases are those showing a positive immunological cross-reaction with the antibody of one of the following lipases: lipase ex *Chromobacter viscosum* var. lipolyticum NRRLB 3673, as sold by Toyo Jozo Co., Tagata, Japan, and lipase ex *Pseudomonas gladioli.*

Typical examples of such lipases are Amano-P, Amano-B, Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from US Biochemical Corp., U.S.A. and Diosynth Co., The Netherlands, and lipases ex *Pseudomonas gladioli.*

Other preferred lipases are lipases produced by cloning, by rDNA technologies, the gene encoding for the lipase produced by the fungus *Humicola lanuginosa* and expressing the gene in *Aspergillus oryzae* as host. A particularly preferred lipase is manufactured and sold by Novo Industri A/S, Denmark, under the trade name Lipolase (see Biotechnology Newswatch, published 7 March 1988, page 6).

Lipases which are immunologically identical or similar to such lipases may also be used in the present invention.

Further suitable lipases are for example: the lipases described in for example the following patent specifications, EP 0 214 761 (Novo), EP 0 258 068 (Novo) and especially lipases showing immunological cross-reactivity with antisera raised against lipase from Thermomyces lanuginosus ATCC 22070, EP 0 205 208 (Unilever) and EP 0 206 390 (Unilever): and especially lipases showing immunological cross-reactivity with antisera raised against lipase from Alcaligenes PL-679, ATCC 31371 and FERM-P 3783, also the lipases described in specifications WO 87/00859 (Gist-Brocades) and EP 0 204 284 (Sapporo Breweries). Suitable in particular are for example the following further commercial lipase preparations: Amano lipases CE, AP, M-AP, AML and Meito lipases MY-30, OF, and PL, also esterase MM, Lipozym, SP225, SP285, Saiken lipase and Enzeco lipase (Trade Marks).

Genetic engineering of the enzymes can be achieved by extraction of an appropriate lipase gene, e.g., the gene for lipase from *Thermomyces lanuginosus* or from a mutant thereof, and introduction and expression of the gene or derivative thereof in a suitable producer organism such as an Aspergillus. The techniques described in WO 88/02775 (Novo), EP 0 238 023 (Novo), EP 0 243 338 (Labofina) and EP 0 268 452 (Genencor) may be applied and adapted. Such enzymes can be referred to as enzymes producible by the respective ancestor organism, even where subsidiary features of the enzyme material, e.g., degree of glycosylation, differ as between the product of the ancestor organism and the product of the producer organism. All of the above-cited specifications are hereby incorporated herein by reference.

Particularly suitable lipases are for example those mentioned in EP 0 305 216 (Novo), hereby incorporated herein by reference.

Preferred lipases at the present time are Lipolase (Novo (TM)) and lipase from *Pseudomonas gladioli*, or their rDNA-derived equivalents.

The lipases of the present invention are included in the detergent composition in such an amount that the final detergent composition has a lipolytic enzyme activity of from 100 to 0.005 LU/mg, preferably 25 to 0.05 LU/mg of the composition.

In particular cases the added amount of lipolytic enzyme can be chosen within wide limits, for example 50 to 30,000 LU/g of granular detergent composition, e.g., often at least 100 LU/g, very usefully at least 500 LU/g, sometimes preferably above 1000, above 2000 LU/g or above 4000 LU/g or more, thus very often within the range 50–4000 LU/g and possibly within the range 200–1000 LU/g.

A Lipase Unit (LU) is that amount of lipase which produced 1 μmol of titratable fatty acid per minute in a pH stat. under the following conditions: temperature 30° C.; pH=9.0; substrate is an emulsion of 3.3 wt % of olive oil and 3.3% gum arabic, in the presence of 13 mmol $Ca^{2+}$ and 20 mmol NaCl in 5 mmol Tris-buffer.

Naturally, mixtures of the above lipases can be used. The lipases can be used in their impurified form, or in a purified form, e.g. purified with the aid of well-known adsorption methods, such as a phenylsepharose-packed column technique. The lipases may usefully be added as a granular composition of lipolytic enzyme with carrer material (see e.g., EP 0 258 068) or as a slurry.

The detergent composition incorporating the lipases contains as active detergent material a mixture of one or more nonionic synthetic detergent-active materials and one or more anionic synthetic detergent-active materials.

The anionic detergent-active materials are well known in the art, and suitable examples are fully described in Schwartz, Perry and Berch, Surface-Active Agents and Detergents, Vol.I (1949) and Vol.II (1958) and in Schick, Nonionic Surfactants, Vol.1 (1967).

The anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

The nonionic detergent-active material generally consists to the extent of at least 30% by weight of the total nonionic detergent-active material, of a nonionic detergent-active material which is an alkoxylate adduct with a low alkoxylation degree of fatty compounds selected from fatty alcohols, fatty acids, fatty esters, fatty amides and fatty amines. The fatty compound contains at least 10 carbon atoms and the nonionic material contains an average of less than 5 alkylene oxide groups per molecule, for example less than 4 alkylene oxide groups per molecule, e.g. 3.5 and usefully 3 alkylene oxide groups per molecule or less, and usefully also greater than 0.5, or 1, or 2, alkylene oxide groups per molecule.

The alkylene oxide residues may for example be ethylene or propylene oxide residues.

Thus alkylene oxide adducts of fatty alcohols useful in the present invention can usefully be chosen from those of the general formula:

$$R—O—(C_nH_{2n}O)_yH$$

wherein R is an alkyl or alkenyl group having at least 10 carbon atoms, most preferably from 10 to 22 carbon atoms, y is preferably from about 0.5 to about 3.5 and n is 2 or 3. Preferred and suitable examples of such materials include Synperonic A3 (ex ICI), which is a $C_{13}$–$C_{15}$ alcohol with about three ethylene oxide groups per molecule and Empilan KB3 (ex Marchon), which is lauric alcohol 3EO.

Alkylene oxide adducts of fatty acids useful in the present invention preferably have the general formula:

$$R—\underset{\underset{O}{\|}}{C}—O—(C_nH_{2n}O)_yH$$

wherein R, n and y are as given above. Suitable examples include ESONAL 0334 (ex Diamond Shamrock), which is a tallow fatty acid with about 2.4 ethylene oxide groups per molecule.

Alkylene oxide adducts of fatty esters useful in the present invention include adducts of mono-, di- or tri-esters of polyhydric alcohols containing 1 to 4 carbon atoms, such as coconut or tallow oil (triglyceride) 3EO (ex Stearine Dubois).

Alkylene oxide adducts of fatty amides useful in the present invention preferably have the general formula:

$$R—\underset{\underset{O}{\|}}{C}—N\begin{matrix}(C_nH_{2n}O)_xH\\(C_nH_{2n}O)_zH\end{matrix}$$

wherein R is an alkyl or alkenyl group having at least 10 carbon atoms, most preferably from 10 to 22 carbon atoms, n is 2 or 3 and x and z in total are not more than 4.0, preferably from about 0.5 to about 3.5, while one of x and z can be zero. Examples of such materials include coconut monoethanolamide and diethanolamide, and the corresponding tallow and soya compounds.

Alkylene oxide adducts of fatty amines useful in the present invention preferably have the general formula:

$$R—N\begin{matrix}(C_nH_{2n}O)_xH\\(C_nH_{2n}O)_zH\end{matrix}$$

wherein R and n are as given above, and x and z in total are preferably not more than about 4.0, most preferably from about 0.5 to about 3.5. Examples of such materials include Ethomeen T12 (tallow amine 2EO, available from AKZO), Optameen PC5 (coconut alkylamine 5EO) and Crodamet (1.02 (oleylamine 2EO, available from Croda Chemicals).

One useful criterion of selection for a nonionic surfactant for use in certain desirable embodiments of the invention is that it gives a cloudy phase (at 1% w/w in distilled water) somewhere in the temperature range of 0°–40° C.

Preferably the nonionics are chosen that have a HLB value of about 5–10.5, e.g., about 7–9.

The weight ratio of the nonionic with the low alkoxylation degree of the anionic detergent is preferably less than 1:1, usually less than 1:2, e.g., in the range 1:1 to 1:3, or 1:1 to 1:4, and often ranges from 1:2.4 to 1:3.

The amount of nonionic and anionic detergent-active material together in the detergent compositions can range from 1 to 30%, very often below 25%, usually 2 to 20%, and often 6 to 16% by weight. Several preferred embodiments have total surfactant in the range 10–20% by weight.

Detergent materials of other types, such as soaps, cationics and zwitterionic or amphoteric detergents, e.g. amine oxides, may also be included.

The detergent composition may furthermore include the usual detergent ingredients in the usual amounts. They may be unbuilt or built, and may be of the zero-P type (i.e. not containing phosphorus-containing builders).

Thus, the composition may contain from 1–45%, preferably from 5–30% by weight of one or more organic and/or inorganic builders. Typical examples of such builders are the alkali metal ortho-, pyro- and tripolyphosphates, alkali metal carbonates, either alone or in admixture with calcite, alkali metal citrates, alkali metal nitrilotriacetates, carboxymethyloxysuccinates, zeolites, polyacetalcarboxylates and so on. Furthermore, it may contain from 1–35% of a bleaching agent or a bleaching system comprising a bleaching agent and an activator therefore, e.g. sodium perborate plus TAED. Stronger bleach systems can also be used, e.g. DPDA (=diperoxy dodecanedioic acid) or sodium perborate with bleach precursors which form peracids faster than with TAED, e.g. as described in EP 0 271 152 (Unilever).

Preferred for many purposes and especially advantageous in terms of detergent performance when lipase is present are compositions non-phosphate builder and substantially free of phosphorus-containing builder, (e.g. with less than about 1% thereof).

The compositions may furthermore comprise lather boosters, foam depressors, anti-corrosion agents, soil-suspending agents, softening agents, clays, sequestering agents, anti-soil redeposition agents, perfumes including perfumes as disclosed in our European Patent 0003172, dyes, stabilising agents for the enzymes and so on. They may also comprise enzymes other than lipases, such as proteases, amylases, oxidases and cellulases.

Examples of the other ingredients are polymers which may consist of homopolymeric and/or copolymeric carboxylic acid or sulphonate or its sodium or potassium salt, the sodium salts being preferred. Suitable homopolymers are polyacrylic acid, polymethacrylic acid, polymaleic acid, and polystyrene sulphonic acid. Suitable copolymers are those of acrylic acid, methacrylic acid, and maleic acid with vinyl ethers such as vinyl acetate or vinyl propionate, acrylamide, methyacrylamide and ethylene, propylene, or styrene, or styrene sulphonate. In the copolymeric acids in which one of the components does not contain an acid function, the content of this component is not more than 70 mole %, preferably less than 60% mole, in the interests of sufficient water solubility. Copolymers of acrylic acid with maleic acid, as characterised further, e.g. in EP 25 551-B1 and in Tenside 1979, 16, 82–89, have proved to be particularly suitable. These are copolymers containing 40 to 90 wt % of acrylic or methacrylic acid and 60 to 10 wt % of maleic acid. Copolymers of this type containing 45 to 85 wt % of maleic acid. Copolymers of this type containing 45 to 85 wt % of acrylic acid and 55 to 15 wt % of maleic acid are particularly preferred. The molecular weights of the homopolymers and co-polymers are generally 1000 to 150,000, preferably 1500 to 100,000.

Other suitable polymeric materials are cellulose ethers such as carboxy methyl cellulose, methyl cellulose, hydroxy alkyl celluloses, and mixed ethers, such as methyl hydroxy ethyl cellulose, methyl hydroxy propyl cellulose, and methyl carboxy methyl cellulose. Mixtures of different cellulose ethers, particularly mixtures of carboxy methyl cellulose and methyl cellulose, are suitable. Polyethylene glycol of molecular weight from 400 to 50,000, preferably from 1000 to 10,000 and co-polymers of polyethylene oxide with polypropylene oxide are suitable as also are co-polymers of polyacrylate with polyethylene glycol. Polyvinyl pyrrolidone of molecular weight of 10,000 to 60,000 preferably of 30,000 to 50,000 and co-polymers of poly vinyl pyrrolidone with other poly pyrrolidones are suitable. Polyacrylic phosphonates and related co-polymers of molecular weight 1000 to 100,000, in particular 3000 to 30,000 are also suitable.

The compositions of the present invention can be formulated in any desired form, such as powders, bars, pastes, liquids, etc. Very often the compositions can yield wash solutions with pH about 7–10.5, e.g. about 9–10, for example when dissolved or dispersed in water to yield surfactant concentration of about 0.8 g/l.

For example, a detergent according to the present invention can take the form of a granulate having a bulk density of at least 600 g/l and sufficiently low or zero neutral inorganic salt (e.g. sodium sulphate), phosphate or aluminosilicate builder and minors to yield a wash solution with ionic strength of about 0.04 or less, e.g. about 0.03 or less, e.g. about 0.025 or 0.02 or less when the composition is dispersed in water to yield a washing liquor with about 0.8 g/l surfactant concentration.

Furthermore, detergent liquids according to the present invention can be formulated as substantially nonaqueous liquid detergent compositions comprising a solution (dispersion formulated e.g. as in EP 0 266 199 (incorporated herein by reference).

The invention will now further be illustrated by way of the following examples. The compositions in which the nonionic surfactant is a 7EO material (only) are for illustrative comparison.

EXAMPLE 1

Washing experiments were carried out with the following formulations:

| | A | B | C | D |
|---|---|---|---|---|
| sodium dodecylbenzene sulphonate | 9 | 9 | 9 | 9 |
| $C_{13}$–$C_{15}$ linear primary alcohol, condensed with 7 moles of ethylene oxide (e.g. Synperonic A7) | 1 | 4 | 4 | 1 |
| $C_{13}$–$C_{15}$ linear primary alcohol, condensed with 3 moles of ethylene oxide (e.g. Synperonic A3) | 3 | — | — | 3 |
| sodium tripolyphosphate | 23 | 23 | — | — |
| zeolite type 4A | — | — | 24 | 24 |
| copolymer of acrylic acid with maleic anhydride | — | — | 4 | 4 |
| sodium polyacrylate | 2 | 2 | — | — |
| alkaline silicate | 5 | 5 | — | — |
| fluorescer | 0.25 | 0.25 | 0.16 | 0.16 |
| EDTA | 0.15 | 0.15 | 0.18 | 0.18 |
| SCMC | 0.5 | 0.5 | 0.55 | 0.55 |

-continued

| | A | B | C | D |
|---|---|---|---|---|
| salt | 2 | 2 | — | — |
| sodium sulphate | 26.8 | 26.8 | 22.31 | 22.31 |
| sodium carbonate | — | — | 10.30 | 10.30 |
| moisture | 10 | 10 | 11 | 11 |
| TAED | 3 | 3 | 3.3 | 3.3 |
| sodium perborate monohydrate | 10 | 10 | 8 | 8 |
| calcium Dequest ® 2047 | 0.7 | 0.7 | 0.3 | 0.3 |
| foam depressor | 3 | 3 | 2.5 | 2.5 |
| perfume | 0.2 | 0.2 | — | — |
| alkaline protease (Savinase ® 6T) | 0.4 | 0.4 | 0.4 | 0.4 |

It is seen that the nonionic detergent with alkoxylation degree of 3 forms in Compositions A and D 75% of the total nonionic detergent and 25% of the sum of the anionic detergent and of the nonionic detergent of low alkoxylation degree.

The washing experiments were carried out under the following conditions:

water hardness: 27° FH test monitor: prewashed cotton soiled with a mixture of inorganic pigments, protein and groundnut oil washing programme: heating for 5 min. to 30° C.; washing for 30 min. at 30° C. with test monitors and clean ballast load (C/L ratio 1:10) and subsequently rinsing three times with tap water dosage of detergent: 5 g/l lipase use:

Lipolase ex Novo
lipase ex Ps.gladioli
lipase MY ex Meito
lipase AP-6 ex Amano dosage of lipase: to yield 0.5, 1, 3 or 15 LU/ml wash liquor After the fourth soil/wash cycle the reflectance of the test cloths and the residual percentage of fatty material on the test cloths were determined. The reflectance was measured in a Reflectometer at 460 nm with a UV filter in the light pathway and the fatty matter by extracting the dried test cloths with petroleum ether, distilling off the solvent and weighing the resulting fatty matter.

The following results were obtained:

| formulation | lipase | concentration | R 460* | % fat |
|---|---|---|---|---|
| A | none | — | 61 | 15.79 |
| A | Lipolase | 0.5 LU/ml | 61.6 | 14.2 |
| A | | 1 LU/ml | 60.7 | 15.36 |
| A | | 3 LU/ml | 61.7 | 14.87 |
| A | | 15 LU/ml | 69.4 | 9.35 |
| A | *Ps. gladioli* | 0.5 LU/ml | 60.2 | 14.75 |
| A | | 1 LU/ml | 63.2 | 13.06 |
| A | | 3 LU/ml | 67.4 | 10.77 |
| A | | 15 LU/ml | 71.5 | 7.94 |
| A | MY | 15 LU/ml | 59.7 | 16.8 |
| A | AP-6 | 15 LU/ml | 59.9 | 15.5 |
| B | none | — | 54.5 | 17.93 |
| B | Lipolase | 0.5 LU/ml | 55.3 | 17.57 |
| B | | 1 LU/ml | 56.1 | 17.51 |
| B | | 3 LU/ml | 56.1 | 17.14 |
| B | | 15 LU/ml | 63.4 | 12.02 |
| B | *Ps. gladioli* | 0.5 LU/ml | 54.9 | 18.24 |
| B | | 1 LU/ml | 55.6 | 17.68 |
| B | | 3 LU/ml | 61 | 14.99 |
| B | | 15 LU/ml | 69.1 | 8.8 |
| B | MY | 15 LU/ml | 55.2 | 17.96 |
| B | AP-6 | 15 LU/ml | 59.1 | 16.69 |
| C | none | — | 56.2 | 18.53 |
| C | Lipolase | 1 LU/ml | 58.8 | 18.82 |
| C | | 3 LU/ml | 58.9 | 16.23 |
| C | | 15 LU/ml | 68.6 | 9.01 |

-continued

| formulation | lipase | concentration | R 460* | % fat |
|---|---|---|---|---|
| C | *Ps. gladioli* | 1 LU/ml | 57.7 | 16.55 |
| C | | 3 LU/ml | 61.7 | 13.34 |
| C | | 15 LU/ml | 67.6 | 9.5 |
| C | MY | 15 LU/ml | 55.6 | 18.31 |
| C | AP-6 | 15 LU/ml | 57.2 | 18.46 |
| D | none | — | 55.8 | 18.03 |
| D | Lipolase | 1 LU/ml | 58.4 | 16.17 |
| D | | 3 LU/ml | 60.9 | 15.3 |
| D | | 15 LU/ml | 66.5 | 10.31 |
| D | *Ps. gladioli* | 1 LU/ml | 63 | 12.36 |
| D | | 3 LU/ml | 67.5 | 9.57 |
| D | | 15 LU/ml | 68.6 | 8.77 |
| D | MY | 15 LU/ml | 58.2 | 15.2 |
| D | AP-6 | 15 LU/ml | 60.1 | 15.65 |

EXAMPLE 2

A formulation similar to formulation A, but in which 6% of the anionic, 4% of the nonionic with 7EO and 2.5% of the nonionic with 3EO are used, containing 1.5% by weight of Lipolase 30T and 8.5% of carbonate/sulphate double salt produces results similar to those with formulation A in Example 1.

It is seen that in the composition of Example 2, the nonionic detergent of low alkoxylation degree (3) forms about 38.5% of the total nonionic component and about 9.4% of the sum of the anionic detergent and the nonionic component of low alkoxylation degree.

EXAMPLE 3

This example consists of a detergent powder composition similar to Composition D of Example 1 except that the proportion of anionic detergent is 12%, that of the 7-EO-nonionic is 1% and that of the 3-EO-nonionic is 4%. 0.45% of Savinase 4.0T protease is present. Lipolase 100T is used at a rate of 0.5%.

The balance of neutral inorganic salt is adjusted correspondingly.

This example forms a highly preferred embodiment of the invention with superior wash performance to an unexpected degree.

It is seen that in this formulation the 3-EO-nonionic forms 80% of the total nonionic detergent present, and also forms 25% of the sum of the anionic component and the nonionic component of low alkoxylation degree.

The scope of the present disclosure and claims extends to all modifications and variations including combinations and subcombinations of the features set forth herein.

I claim:

1. A detergent composition comprising an anionic surfactant, a nonionic surfactant and a lipase produced by cloning the gene from *Humicola lanuginosa* and expressing the gene in *Aspergillus oryzae* characterized in that:

(a) the nonionic surfactant of the composition comprises a nonionic surfactant component selected from alkoxylate adducts of fatty alcohols, fatty acids, fatty esters, fatty amides and fatty amines of at least $C_{10}$ chain length and mean alkylene oxide content of less than 5 alkylene oxide groups per molecule;

(b) said nonionic surfactant component forms at least 30% by weight of the total nonionic surfactant of the composition;

(c) said nonionic surfactant component forms less than 50% by weight of the sum of the nonionic surfactant component and the anionic surfactant;

(d) the total amount of the nonionic surfactant and anionic surfactant in the composition is in the range of 1% to 30% by weight; and (e) the lipase enzyme is present in an amount of about 0.005 to 100 Lu/mg based on the weight of the detergent composition.

2. A detergent composition according to claim 1, characterized in that the total amount of nonionic surfactant and anionic surfactant in the composition is in the range of 2 to 20% by weight.

3. A detergent composition according to claim 1, characterized in that the nonionic surfactant alkoxylate adduct is selected from $C_{10}$–$C_{22}$ fatty alkyl, alkenyl, alkanoyl and alkenoyl alkoxylates with mean alkoxylation degree in the range of 0.5 to 3.5 ethylene oxide and/or propylene oxide groups per molecule, and $C_{10}$–$C_{22}$ fatty alkylamine, alkenylamine, alkanolamide and alkenolamide N-mono-alkoxylates and N,N-dialkoxylates with mean alkoxylation degree in the range 0.05 to 3.5 ethylene oxide and/or propylene oxide groups per molecule.

4. A detergent composition according to claim 1, comprising 1–45% by weight of a builder selected from zeolites, calcite alkali metal carbonates, citrates, nitrilotriacetates, carbomethylsuccinates, and polyacetalcarboxylates, and substantially free of phosphorus-containing builder compounds.

5. A detergent composition according to claim 1, in the form of a powder.

6. A detergent composition according to claim 5, in the form of a granulate having a bulk density of at least 600 g/l, and sufficiently low or zero neutral salt, phosphate or aluminosilicate builder and minors to yield a wash solution with ionic strength of about 0.04 or less when the composition is dispersed in water in a quantity to yield a washing liquor with about 0.8 g/l surfactant concentration.

7. A detergent composition according to claim 1, in the form of a liquid.

* * * * *